United States Patent [19]

Kroth et al.

[11] Patent Number: 4,458,124

[45] Date of Patent: Jul. 3, 1984

[54] MULTICOLOR ILLUMINATED TOGGLE SWITCH

[75] Inventors: Neil W. Kroth, Cary; Gursharan P.S. Nat, Smithfield, both of N.C.

[73] Assignee: Eaton Corporation, Cleveland, Ohio

[21] Appl. No.: 410,105

[22] Filed: Aug. 20, 1982

[51] Int. Cl.[3] ..... H01H 9/16

[52] U.S. Cl. ..... 200/311; 200/315

[58] Field of Search ..... 200/310, 311, 313, 315, 200/317

[56] References Cited

U.S. PATENT DOCUMENTS

| | | | |
|---|---|---|---|
| 3,251,050 | 5/1966 | Given | 200/311 |
| 3,260,830 | 7/1966 | Albright | 200/312 |
| 3,518,386 | 6/1970 | Guberman | 200/313 |
| 3,727,020 | 4/1973 | Bailey | 200/311 |
| 4,259,559 | 3/1981 | Kondo et al. | 200/311 |
| 4,291,211 | 9/1981 | Discenza | 200/311 |

FOREIGN PATENT DOCUMENTS

| | | | |
|---|---|---|---|
| 1404955 | 5/1965 | France | 200/307 |
| 694180 | 7/1953 | United Kingdom | 200/311 |

*Primary Examiner*—Stephen Marcus
*Assistant Examiner*—Ernest Cusick
*Attorney, Agent, or Firm*—C. H. Grace; L. G. Vande Zande

[57] ABSTRACT

A three-position toggle switch having a transparent toggle lever (28) illuminated in its natural color in the center position and illuminated in second and third colors in its respective left and right positions. Molded color filters (32, 34) are structurally attached to the interior end of the lever by dovetail slots (**28*k*, 28*m*) and dovetail ribs (32*b*, 34*b*) and are retained thereon by confinement within the interior switch cavity (2*a*). The filters (32, 34) have offset legs (32*a*, 32*b*) depending toward a lamp (8) in the switch base (2) to reflect or redirect light rays from the lamp (8**) to enhance color separation while permitting an inexpensive, unfocused lamp to be utilized.

21 Claims, 4 Drawing Figures

MULTICOLOR ILLUMINATED TOGGLE SWITCH

BACKGROUND OF THE INVENTION

This invention relates to illuminated toggle switches wherein the operating handle of the toggle lever is illuminated. More particularly the invention relates to illuminated toggle switches wherein the operating handle of the toggle lever is illuminated in different colors to provide indication of the operating position of the switch contacts.

Illuminated toggle switches having transparent or translucent operating levers which are illuminated by an internal light source have been known heretofore. For example, copending patent application Ser. No. 315,326 of John W. Stearley filed Oct. 26, 1981 as a continuation in part of application Ser. No. 170,411 filed July 21, 1980, now abandoned, and assigned to the assignee of this invention, discloses a toggle switch having a transparent operating lever which is illuminated by a lamp housed within the switch base to provide a constant illumination of the lever for indication of switch location or to provide intermittent, single color illumination to indicate the condition of the switch contacts. U.S. Pat. No. 4,291,211 issued Sept. 22, 1981, to F. J. Discenza discloses a toggle switch which illuminates the lever in one of two possible colors as an indication of switch contact conditions. This switch is a two position toggle switch wherein a colored actuator at the interior end of the toggle lever is is moved into and out of position above an internal lamp. When the colored actuator is moved out of position with respect to the lamp, light from the lamp projects through the stem of the toggle lever to illuminate the lever in its natural color. A colored sleeve may be provided around the stem to illuminate the lever in a color different from its natural coloring if desired, however only two colors are possible in this switch design. The I. J. Guberman U.S. Pat. No. 3,518,386 discloses a toggle lever switch wherein the toggle lever may be illuminated in three colors to indicate three positions of the switch. In this patent, a single light source illuminates several switches by virtue of a plurality of fiber optic cables which deliver a focused beam light source to the interior end of the respective toggle levers. As the lever is operated to its various positions, selected ones of three filters are brought into alignment with the focused light beam to illuminate the handle with the color of the respective filter so aligned.

While these prior switches have been useful for their intended purposes, none have directly addressed the problem of illuminating a multiposition toggle lever with three individual colors from an unfocused incandescent lamp mounted within a switch housing.

SUMMARY OF THE INVENTION

The invention herein described provides a multiposition toggle switch having a transparent or translucent toggle lever operator which is illuminated in in selective colors to indicate switch contact conditions from a single, unfocused incandescent lamp housed within the switch base. The invention provides a means of readily attaching selected colored filters to the interior end of the toggle lever during assembly and a structure that provides improved color separation during operation whereby the handle of the operating lever is illuminated in the true color desired.

The advantages afforded by this invention will be more clearly understood when reading the following specification and claims in conjunction with the accompanying drawings.

DESCRIPTION OF THE PREFERRED EMBODIMENTS

Figure 1:
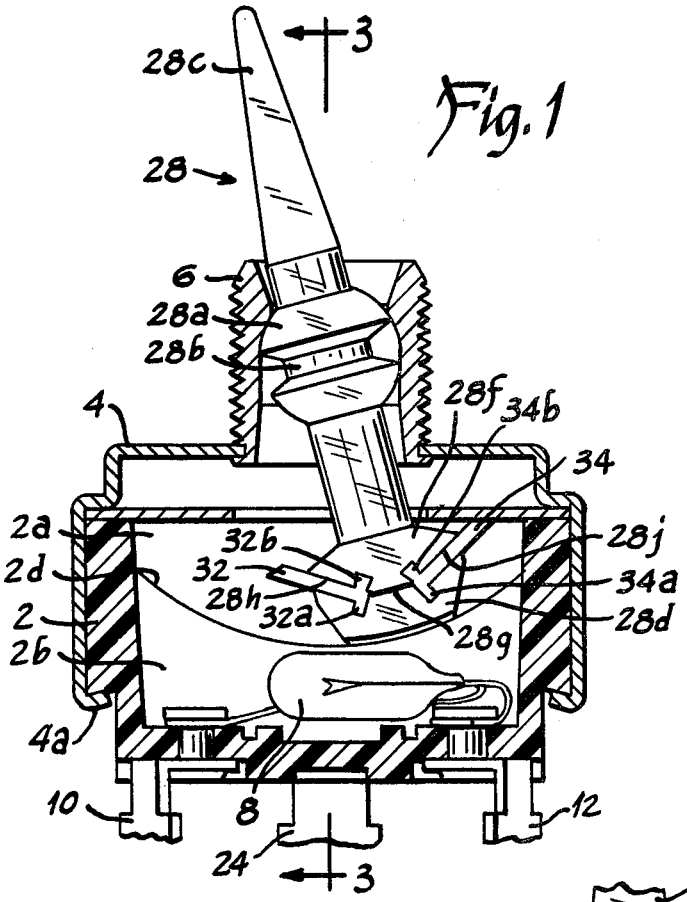
FIG. 1 is an enlarged, longitudinal cross-sectional view taken through one pole of a two-pole, three-position toggle lever switch constructed in accordance with this invention.

Referring to the drawings, the switch of this invention is provided with a housing comprising a molded insulating base 2 and a cover 4 having a bushing 6 projecting from its upper surface. The cover 4 may be a formed metal structure or a molded insulating member as desired. Cover 4 is secured to base 2 by hook portions 4*a* which engage with mating shoulders formed on the base. The base 2 has an internal cavity 2*a* which is divided into separate longitudinally extending compartments 2*b* and 2*c* by a longitudinally extending upstanding wall 2*d*. Compartment 2*b* contains an incandescent lamp positioned to have its filament substantially centered within the compartment. Lamp 8 has two wire leads which are connected to respective terminals 10 and 12 in the compartment 2*b*.

Figure 2:
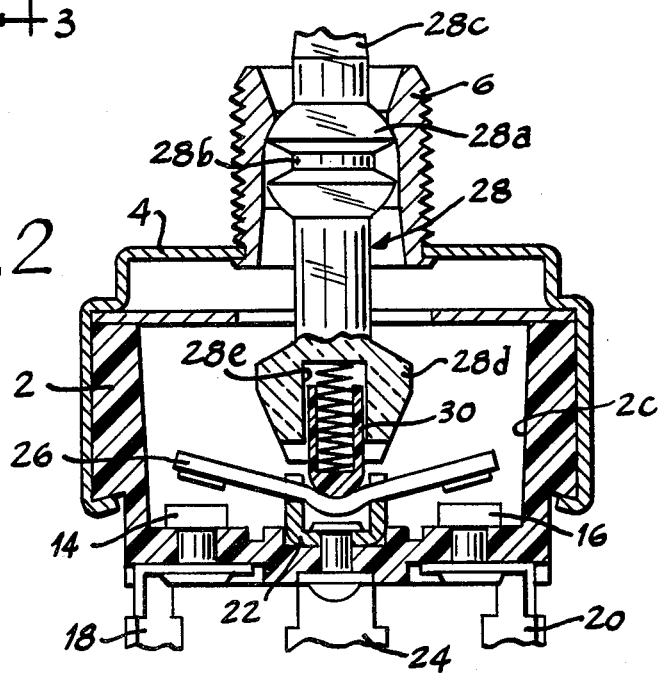
FIG. 2 is a longitudinal cross-sectional view taken through a second pole of the switch of FIG. 1.

Referring particularly to FIG. 2, compartment 2*c* contains the switch contacts which comprise a pair of stationary contacts 14 and 16 connected to external terminals 18 and 20, respectively, and a center common contact 22 connected to an external terminal 24. Common contact 22 is a U-shaped cradle member providing a pair of pivot surfaces for a rocking contactor 26. In a manner which is well known in the art, the shape of common contact cradle 22 and rocking contactor 26 may be varied to attain different operating characteristics for the switch such as momentary or distinct positions in the center, left and/or right positions as desired. In the version illustrated, the contact structure provides three distinct operating positions, i.e. a center position, a left position, and a right position.

A toggle lever operator 28 is pivotly supported in the bushing 6 by an enlarged substantially spherical boss 28*a* molded integrally with the lever 28. The internal bore of bushing 6 is provided with a spherically shaped restriction near its upper end to receive the portion 28*a* of the lever, thereby forming a ball and socket joint for the toggle lever. Spherical boss 28*a* also has an annular groove 28*b* formed therein which may receive a disk-shaped rubber member (not shown) which seats within the groove 28*b* and against the internal bore of bushing 6 to seal the switch against dust and/or liquids as disclosed in the aformentioned copending patent application Ser. No. 315,326. The exterior end of toggle lever 28 is formed to provide an operatig handle 28*c*. The interior end thereof is provided with an enlarged portion 28*d* which is offset laterally of the axial center of the toggle lever to be disposed within the compartment 2*c*. Enlarged portion 28*d* has a cylindrical bore 28*e* open to its lower end in which is provided a spring biased plunger 30. The plunger 30 is biased against the upper surface of contactor 26 and in the switch position shown in FIG. 2, the plunger biases the contactor 26 to seat firmly between the upstanding legs of common contact cradle 22 to provide a distinct, stable center operating position. In a well known manner, manual movement of the handle portion 28*c* of lever 28 to the left or right will pivot the lever 28 about the ball and socket joint to cause the interior end of the lever to move right or left, respectively, thereby carrying the plunger 30 along the upper surface of contactor 26 and cover center of the respective pivot points for the contactor provided by the respective legs of the cradle 22. In either right or left over center position, the plunger 30 biases the movable contactor 26 into engagement with the respective stationary contacts 16 or 14, thereby completing an electrical circuit from the common contact 22 to the respective stationary contact 16 or 14. The over center actuation of the contactor 26 in either the left or right end positions provides a distinct, stable operating position for the switch and the lever remains in that position until manual pressure is applied to the handle 28*c* to move it to a different position.

Figure 4:
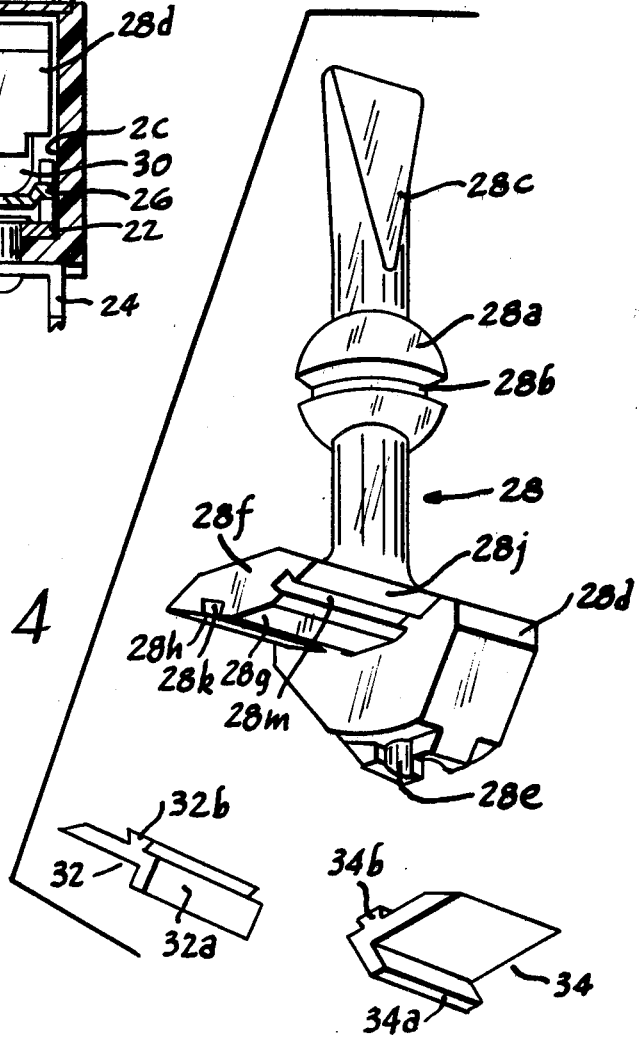
FIG. 4 is an exploded isometric view of the toggle lever and filters used in the switch of this invention.

Lever 28 is preferably a one piece member molded of a transparent or translucent insulating material. Referring particularly to FIG. 4, the interior end of the lever is provided with a cantilever portion 28*f* projecting laterally from the enlarged portion 28*d*. The underside of cantilever portion 28*f* is provided with a first surface 28*g* which is disposed normal to the longitudinal axis of the lever 28. A pair of surfaces 28*h* and 28*j* are provided on either side of surface 28*g* disposed in angular planes to the surface 28*g*, the surfaces 28*h* and 28*j* forming an external reflex angle with respect to the bottom of the compartment 2*b*. Laterally extending dovetail slots 28*k* and 28*m* are provided in the surfaces 28*h* and 28*j*, respectively.

Figure 3:
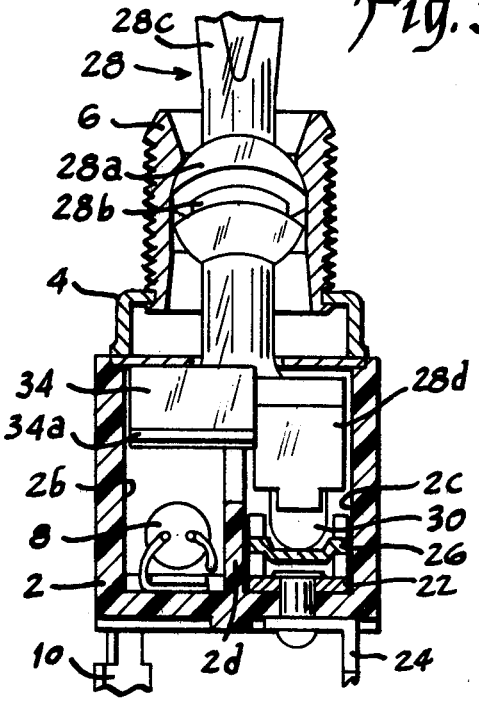
FIG. 3 is a lateral cross-sectional view taken through the center of the switch of FIGS. 1 and 2 substantially along the line 3—3 of FIG. 1.

A pair of molded transparent colored filters 32 and 34 are provided for attachment to the cantilevered portion 28*f*. The filters 32 and 34 are L-shaped members having unequal length legs, the shorter legs 32*a* and 34*a*, respectively, being offset at right angles with respect to the longer legs thereof. Dovetail ribs 32*b* and 34*b*, respectively, are formed on the upper surface of each of the filter members 32 and 34. The filters are prefermolded of a transparent colored material, the color of the filter 32 being different from the color of filter 34. The filters are structurally attachable to the lever 28 by inserting the dovetail ribs into the dovetail slots of cantilevered portion 28*f* from the laterally projecting free end thereof toward the enlarged portion 28*d*. The width of the filters and the respective dovetail ribs are preferably the same as the width of the cantilevered portion 28*f* so that when the filters are fully inserted, the ends thereof are flush with the free, lateral end of cantilevered portion 28*f*. This method of attachment of the filters to the cantilevered portion of the lever is preferred over other means such as by gluing the members in place inasmuch as it speeds up assembly time thereby reducing the manufacturing costs of the switch, and causes no interreaction between the mating surfaces 28*h*, 28*j* and their respective filters such as might occur when using adhesives to secure the filters and which might tend to reduce the transmission of light therebetween. As may be seen particularly in FIG. 3, the overall width of the interior end of lever 28 from the lateral surface of cantilevered portion 28*f* to the opposite lateral surface of enlarged portion 28*d* is only slightly less than the width of the cavity 2*a* of switch base 2. Accordingly, the lever 28 is prevented from rotating axially within the switch cavity due to the close structural spacing of its lateral surfaces and the interior of the switch cavity. Moreover, the filters are prevented from sliding laterally outward of the cantilevered portion 28*f* and becoming detached therefrom by virtue of the close spacing with the interior sidewall of the switch cavity 2*a*.

As seen particularly in FIG. 1, the offset legs 32*a* and 34*a* of filters 32 and 34, respectively, depend from the lower interior end of toggle lever 28 toward the lamp 8 at a divergent angle. With the lever 28 operated to the position shown in FIG. 1, and assuming that the terminals 10 and 12 are connected to an electrical source so as to illuminate the filament of lamp 8, light rays are emitted from the lamp filament in all directions within the interior of the switch base. In this position of the lever 28, the filter 32 is positioned directly over the filament of lamp 8 and light rays emanating from the filament of the lamp pass through the filter 32 into the toggle lever 28 and are transmitted through the toggle lever to the handle portion 28*c*. If for instance the toggle lever 28 is made of a clear or uncolored plastic material, and the filter 32 is made of a red material, the light rays will take on the red color of the filter 32 and will illuminate the handle in a red color indicating closure for example of the contactor 26 and stationary contact 16. Light rays emanating from the filament of lamp 8 toward the filter 34 will strike the offset leg 34*a* and will be refracted away from the toggle lever 28 or will be reflected from that surface toward the filter 32, but in either instance will not be reflected or transmitted through the lever 28. Accordingly the color of the filter 34, which may be for example green, will not be transmitted to the handle 28*c* of the lever 28 and mixed with the desired red illumination. When the lever 28 is moved to its center position as shown in FIG. 2, the surface 28*g* of cantilevered portion 28*f* is positioned directly over the filament of lamp 8. Light rays emanating from the filament of the lamp are transmitted directly through the lever to the handle to illuminate the handle in its natural color. In this position, light rays emanating from the lamp filament and striking the offset legs 32*a* and 34*a* of the filters 32 and 34, respectively, are either reflected from the smooth surfaces of the offset legs of the filter toward the offset leg of the opposite filter or are transmitted through the filters and are refracted to be directed to opposite upper internal areas of the switch housing, but are not transmitted through the lever. It will be appreciated that when the toggle lever is moved to the angular position opposite that shown in FIG. 1, the filter 34 will be immediately over the filament of lamp 8 and will illuminate the handle in a green color in a manner identical to that described in conjunction with filter 32.

While the invention has been described herein in conjunction with a three-position switch which provides three colors of illumination for the toggle lever handle indicative of switch contact positions, it is to be understood that it is susceptible of various modifications without departing from the scope of the appended claims. For example, the switch contact mechanism could be modified to provide two distinct operating positions in the left and right angular positions of the lever whereupon the lever would be illuminated with two colors, as dictated by the colors of the respective filters or one or the other of the filters could be eliminated and the lever would be illuminated in its natural color in one of the angular positions.

We claim:

1. An illuminated toggle switch comprising, in combination:

a housing;

switch contacts in said housing;

a light source mounted in said housing;

a light transmissive toggle lever pivotally mounted in said housing for reciprocal movement, said lever comprising an operating handle at its exterior end and having operative connection with said switch contacts at its interior end, said interior end of said lever further comprising a portion overlying said light source;

light transmissive colored filter means attached to said overlying portion wherein said reciprocal movement of said toggle lever actuates said switch contacts and carries said filter means into and out of position over said light source for transmitting colored or uncolored light, respectively, through said lever to said handle; and complementally shaped attachment means on said overlying portion and said filter means for structurally attaching said filter means to said overlying portion, said attachment means comprising a dovetail slot and a dovetail rib, said filter means being slideably attached to said overlying portion from a lateral edge of said overlying portion.

2. The invention defined in claim 1 wherein said housing comprises interior sidewalls parallel to the direction of reciprocal movement of said lever and said lever is positioned in said housing wherein said lateral edge of said overyling portion is in closely spaced relation to one of said sidewalls to prevent said filter means from slideably detaching from said overlying portion.

3. The invention defined in claim 2 wherein said dovetail slot is formed in said overlying portion of said lever and said dovetail rib is formed on said filter means.

4. An illuminated toggle switch comprising, in combination:

a housing;

switch contacts mounted in said housing;

an unfocused light source mounted in said housing;

a light transmissive toggle lever pivotally mounted in said housing, said lever having an operating handle at its exterior end and an operative connection with said switch contacts at its interior end, said interior end further comprising a portion overlying said light source;

a pair of light transmissive colored filters, each of a different color, attached to said overlying portion in spaced apart relation to provide an unfiltered area of said overlying portion between said filters, the respective ends of said pair of filters adjacent said unfiltered area having offset legs projecting away from said overlying portion;

wherein movement of said toggle lever actuates said switch contacts and carries respective ones of said filters and said unfiltered area into and out of position over said light source for transmitting colored or uncolored light through said lever into said handle; and wherein the offset leg of a filter not positioned over said light source directs light colored by that filter away from said lever.

5. The invention defined in claim 4 wherein said filters are attached to said overlying portion in angular planes which diverge away from said light source.

6. The invention defined in claim 5 wherein said filters are L-shaped having unequal length legs and said offset leg is the shorter leg.

7. The invention defined in claim 6 wherein said legs of said L-shaped filters are joined at right angles.

8. The invention defined in claim 7 wherein said switch contacts are arranged to provide a distinct center operating position and left and right operating positions of said lever, said unfiltered area being positioned over said light source in said center operating position and a respective one of said pair of colored filters being positioned over said light source in one of said left and right operating positions.

9. The invention defined in claim 8 wherein said left and right operating positions are distinct operating positions.

10. The invention defined in claim 7 wherein said filters are structurally attached to said overlying portion by complementally shaped attachment means on said overlying portion and said filters.

11. The invention defined in claim 10 wherein said attachment means comprise dovetail slots in said overlying portion and a dovetail rib on each of said filters and said filters are slideably attached to said overlying portion from a lateral edge of said overlying portion.

12. The invention defined in claim 11 wherein said housing comprises interior sidewalls parallel to the direction of movement of said lever and said lever is positioned in said housing wherein said lateral edge is in closely spaced relation to one of said sidewalls to prevent said filters from slideably detaching from said overlying portion.

13. A multiposition illuminated toggle switch comprising, in combination:

an insulating base having a cavity therein defined by opposed pairs of sidewalls and endwalls and separated into a pair of compartments by a dividing wall parallel to said sidewalls;

switch contacts in one of said compartments;

an unfocused light source in the other said compartments;

a cover secured to said base and having a bushing projecting from said cover;

a light transmissive lever pivotally mounted in said bushing, said lever having an operating handle at one end projecting exteriorly of said bushing, an enlarged portion at its interior end disposed over said one compartment, and a cantilever portion projecting from said enlarged portion across said dividing wall and overlying said other compartment;

resilient means carried by said enlarged portion forming an operative connection with said switch contacts;

a pair of light transmissive colored filters, each of a different color, attached to said cantilever portion in spaced apart relation to provide an unfiltered portion between said filters, respective ends of said pair of filters adjacent said unfiltered area having offset legs projecting away from said cantilever portion;

wherein movement of said toggle lever actuates said switch contacts and carries respective ones of said filters and said unfiltered area into and out of position over said light source for transmitting colored or uncolored light through said lever into said handle; and wherein the offset leg of a filter not positioned over said light source directs light colored by that filter away from said lever.

14. The invention defined in claim 13 wherein said filters are attached to said cantilever portion in angular planes which diverge away from said light source.

15. The invention defined in claim 14 wherein said filters are L-shaped having unequal length legs, said offset leg being the shorter leg.

16. The invention defined in claim 5 wherein said legs of said L-shaped filters are joined at right angles.

17. The invention defined in claim 16 wherein said filters are structurally attached to said cantilever portion by complementally shaped attachment means on said cantilever portion and filters.

18. The invention defined in claim 17 wherein said attachment means comprises dovetail slots in said cantilever portion and a dovetail rib on each of said filters, and said filters are slideably attached to said cantilever portion from a free end thereof.

19. The invention defined in claim 18 wherein said lever is reciprocally movable in a path parallel to said sidewalls and said free end of said cantilever portion is spaced from one of said sidewalls by an amount less than the length of said dovetail slot and rib to prevent said filters from slideably detaching from said cantilever portion.

20. The invention defined in claim 17 wherein said switch contacts are arranged to provide a distinct center operating position and left and right operating positions of said lever, said unfiltered area being positioned over said light source in said center operating position and a respective one of said pair of colored filters being positioned over said light source in one of said left and right operating positions.

21. The invention defined in claim 2 wherein said left and right operating positions are distinct operating positions.

* * * * *